United States Patent [19]

Grover

[11] 4,401,924

[45] Aug. 30, 1983

[54] SPEED CONTROL APPARATUS FOR WINDING LINEAR MATERIAL

[75] Inventor: Raymond H. Grover, Santa Clara, Calif.

[73] Assignee: Owens-Corning Fiberglas Corporation, Toledo, Ohio

[21] Appl. No.: 300,411

[22] Filed: Sep. 8, 1981

[51] Int. Cl.[3] ..... B65H 59/38

[52] U.S. Cl. ..... 318/6; 318/7; 318/309; 318/404; 318/415; 242/18 G

[58] Field of Search ..... 242/18 G, 18 CS, 45; 318/7, 309, 310, 311, 329, 333, 269, 273, 275, 310, 329, 364, 449, 404-406, 415, 369, 6, 301, 306, 362, 363, 594; 65/2, 10.1; 364/470, 473

[56] References Cited

U.S. PATENT DOCUMENTS

| | | | |
|---|---|---|---|
| 3,317,153 | 5/1967 | Raymond | 318/311 X |
| 3,771,324 | 11/1973 | Klink et al. | 242/18 G X |
| 3,838,827 | 10/1974 | Klink et al. | 242/18 G |
| 3,861,609 | 1/1975 | Klink et al. | 242/18 G X |
| 4,146,376 | 3/1979 | Beckman et al. | 242/18 G X |
| 4,181,877 | 1/1980 | Gemp | 242/45 X |

FOREIGN PATENT DOCUMENTS

| | | | |
|---|---|---|---|
| 55-112608 | 8/1980 | Japan | 318/415 |

*Primary Examiner*—Ulysses Weldon

*Attorney, Agent, or Firm*—Ronald C. Hudgens; Patrick P. Pacella; Ronald E. Champion

[57] ABSTRACT

A system for winding linear material, such as strands of molten glass, into a package includes a mechanism for collecting the strands, a motor for rotating the collecting mechanism, a drive mechanism for controlling the speed of the motor in proportion to the frequency of a signal applied thereto, and a digital frequency generator for producing such a signal. The generator permits an initial frequency and a rate of change of frequency to be manually selected so that the speed of the motor is periodically decreased to maintain a substantially constant circumferential speed of the package thereby keeping the strand under constant tension. The generator includes a mechanism for digitally storing a manually selected number and a mechanism for generating a signal having a frequency that is proportional to the stored number. A mechanism for periodically incrementing the stored number at a selected rate produces a changing frequency and hence changing motor speed to maintain constant strand tension.

8 Claims, 3 Drawing Figures

1MHZ
÷10
1HZ
FF
C
S1
S2
S3
S4
S5
S6
10HZ
PLL
ØCOMP.
F
R1
R2
C1
PLL
VCO
100HZ
+15V
+V

SPEED CONTROL APPARATUS FOR WINDING LINEAR MATERIAL

BACKGROUND OF THE INVENTION

This invention relates generally to the production of continuous linear material such as strands of glass, yarn or the like which is wound into packages on the collet of a winder. More specifically this invention relates to a speed control apparatus for controlling the rotational speed of the winder to maintain a constant strand tension.

A strand of heated thermoplastic material such as molten glass is normally packaged by winding the strand about the collet of a winder to form a collection of multiple layers. The multiple layers which accumulate about the collet increase the effective diameter of the collet thereby increasing the circumferential speed and tension upon the strand. The pulling force exerted by the winder effects the diameter of the strand. In order to maintain a constant strand tension and hence constant strand diameter throughout the package, the rotational speed of the winder can be decreased in proportion to the increasing package diameter to maintain a constant circumferential speed.

U.S. Pat. Nos. 3,771,324, 3,838,827 and 3,861,609, all assigned to the assignee of the present invention, disclose apparatus for processing linear elements such as molten glass. In each of these patents an analog control circuit using DC voltages and potentiometers was utilized to control the speed of the winder.

Speed controllers which control the speed of an electric motor in proportion to the frequency of an input signal are commercially available. It is known in the art to employ analog circuitry consisting of potentiometers, DC reference voltages, and circuitry for combining a plurality of voltages, such as summing amplifiers, to produce a variable DC voltage which is converted by a voltage controlled oscillator (VCO) to a variable frequency signal for controlling such speed controllers.

Although such motor control systems have proved generally successful, such analog systems inherently respond to a variety of parameters such as potentiometer wear, power supply voltage variations, and temperature changes. Any variation of the control DC voltage to the VCO due to such parameters will cause a resulting change in the output reference frequency thereby causing an undesirable change in motor speed. Such systems are often difficult to adjust because a plurality of potentiometers must be adjusted. Each adjustment is often dependent to some extent upon the other adjustments thereby making adjustment of the system tedious and time consuming. Therefore, it will be apparent that there exists a need for an apparatus for generating a controllable reference frequency which overcomes or reduces the above difficulties.

SUMMARY OF THE INVENTION

An object of the present invention is to provide a stable reference frequency generator utilizing digital circuitry for controlling a motor speed controller.

A further object of this invention is to provide a digital reference frequency generator having a manually selectable initial reference frequency and a manually selectable rate of frequency change which are not interdependent on each other.

In general, the present invention is directed to a system for winding linear material, such as strands, into a package. The system includes a means for collecting the strands, a motor for rotating the collecting means, a drive means for controlling the speed of the motor in proportion to the frequency of a signal applied to the drive means, and a digital frequency generator for producing such a signal. The generator permits an initial frequency and a rate of change of frequency to be manually selected so that the speed of the motor is periodically decreased to maintain a substantially constant circumferential speed of the package thereby keeping the strand under constant tension.

The generator includes a means for digitally storing a number the value of which can be manually selected. A means for generating a signal having a frequency that is proportional to the number stored is provided. A means for periodically incrementing the stored number at a selected rate produces a changing frequency and hence changing motor speed.

DETAILED DESCRIPTION

The apparatus of the present invention is particularly, but not exclusively, suited for packaging heated thermoplastic material such as molten glass. The apparatus is generally useful for collecting linear material into wound packages especially in applications where it is desirable to maintain the linear material under a constant tension. For purposes of clarity of explanation, the apparatus is explained below with respect to the packaging of molten glass strands.

The specific focus of the present invention relates to providing a novel digital frequency generator for controlling the speed of a winder by providing a varying frequency signal to a motor speed controller which controls the speed of the motor in proportion to the frequency of such signal. The generator's frequency (and motor speed) is determined by the number stored in a counter. A selected number is loaded into the counter to define the initial speed of the winder. A pulse generating circuit having a selectable rate is coupled to the counter to cause 1 to be substracted from the number stored in the counter each time a pulse is generated. The frequency of the generator decreases in proportion to the rate at which the pulses are generated thereby causing the motor speed controller to proportionately decrease the speed of the winder. The pulse rate is selected to cause the motor speed to decrease at a rate which will maintain a substantially constant circumferential speed of the package of strands and hence keep the tension on the strand a constant.

Figure 1:
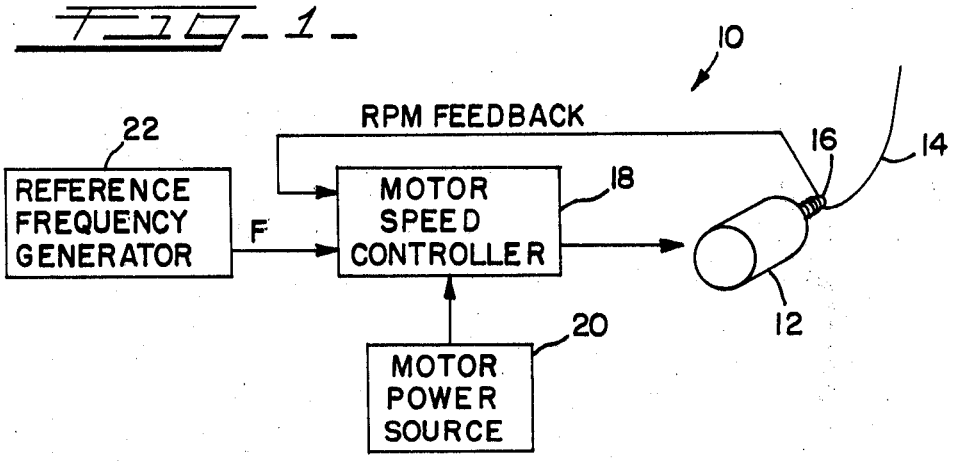
FIG. 1 is a simplified block diagram of a linear material winding system.

In FIG. 1, a system 10 controls the speed of motor 12 which winds a linear material 14 such as molten glass about collet 16. A conventional motor speed controller 18, such as a Model 458 Dynamic Controller available from the Eaton Company, controls the speed of motor 12 in direct proportion to the frequency of the signal provided by reference frequency generator 22 by controlling the energy supplied to the motor from power source 20. A digital tachometer (not shown) coupled to the armature of motor 12 provides the motor speed controller with rpm feedback which enables the controller to regulate the speed of motor 12 in direct proportion to the input frequency of input generator 22. For example, a frequency F of 3500 Hz would produce a motor speed of 3500 rpm.

Figure 2:
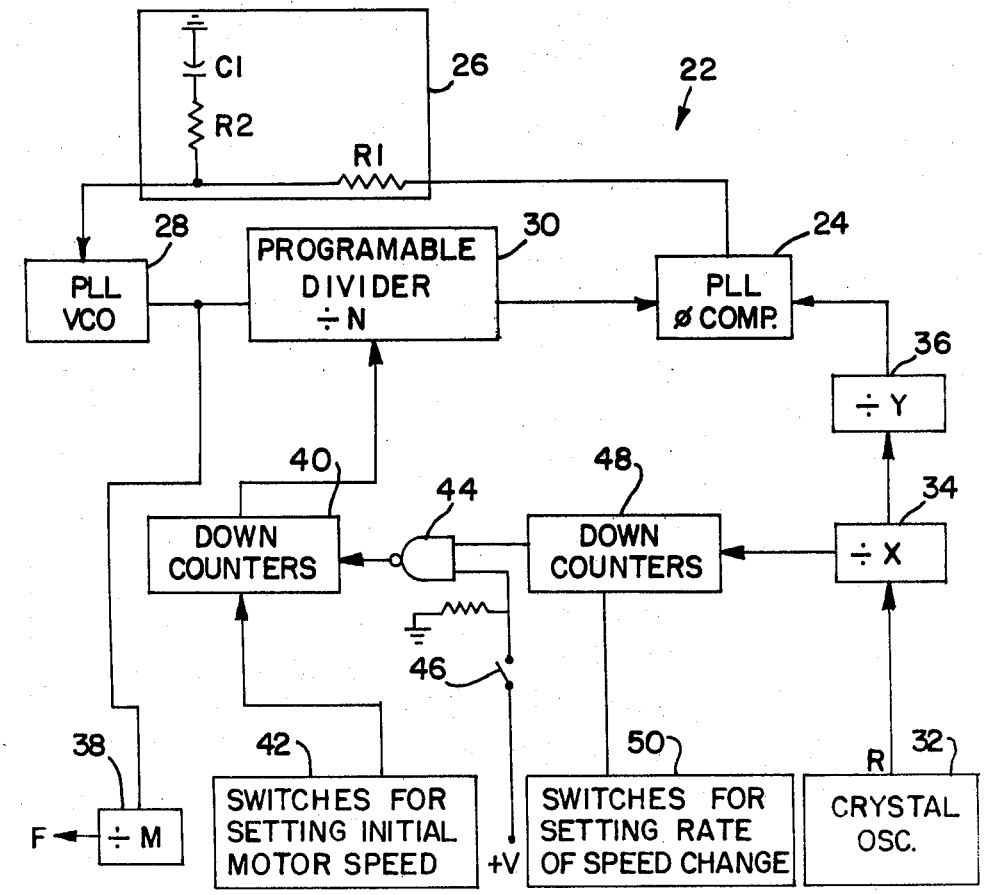
FIG. 2 illustrates a simplified block diagram of an embodiment of a digital reference frequency generator.

FIG. 2 illustrates in simplified block diagram form an embodiment of a reference frequency generator 22 which includes a phase locked loop circuit including phase comparator 24, loop filter 26, VCO 28, and programmable divider 30 which divides by number N. The reference input for the phase comparator is provided by crystal controlled oscillator or clock 32 whose frequency R is divided by dividers 34 and 36 having preselected divisors of X and Y, respectively. The output of the VCO after being divided by divider 38 having a divisor M defines the reference frequency F which the motor speed controller 18 utilizes to control the speed of motor 12. Frequency F is determined from the following equation $F=RN/XYM$. Since the divisor value N of the programmable divider 30 is the only variable in this equation, it will be apparent that the frequency F is directly controlled by N.

The numerical value of N is the number contained in down counters 40. Switches 42 for setting the initial motor speed are manually set to load down counters 40 to a predetermined value N1 which in turn is loaded into programmable divider 30.

The output of inhibit gate 44 is connected to the count down clock input of down counter 40. The inhibit input to gate 44 consists of a switch 46 which when open inhibits gate 44, that is, prevents its output from changing regardless of the other input. The other input to gate 44 consists of a variable pulse rate circuit which includes down counters 48 which are loaded with a number N2 determined by switches 50 and which has its count down clock input connected to an output of divider 34 to provide down counters 48 with a clock frequency of R/X. Counter 48 periodically cycles, i.e. counts, from N2 to zero, is reset to N2, and again counts down.

To start the winding of the strands, switch 46 will be closed thereby enabling gate 44; down counter 40 and programmable divider 30 will both be loaded with the number N1 manually selected by switches 42 which are preferably BCD thumb wheel switches. Down counter 48 which is loaded with the number N2 selected by switches 50 will be counting down towards zero. When down counter 48 reaches zero, a pulse is generated at its output which is coupled through gate 44 to down counters 40 causing the latter to count down by one count so that $N1=N1-1$. Down counters 48 upon reaching zero are immediately reset to the number N2 determined by switches 50 and begin the down counting cycle again. Since the number contained in down counter 40 determines the divisor N in programmable divider 30, each cycle of the down counter 48 substracts 1 from divisor N. As N decreases, F decreases thereby causing a decrease in speed of the motor. The starting speed of the motor is set by switches 42 and the rate at which the speed of the motor decreases is controlled by switches 50.

Figure 3:
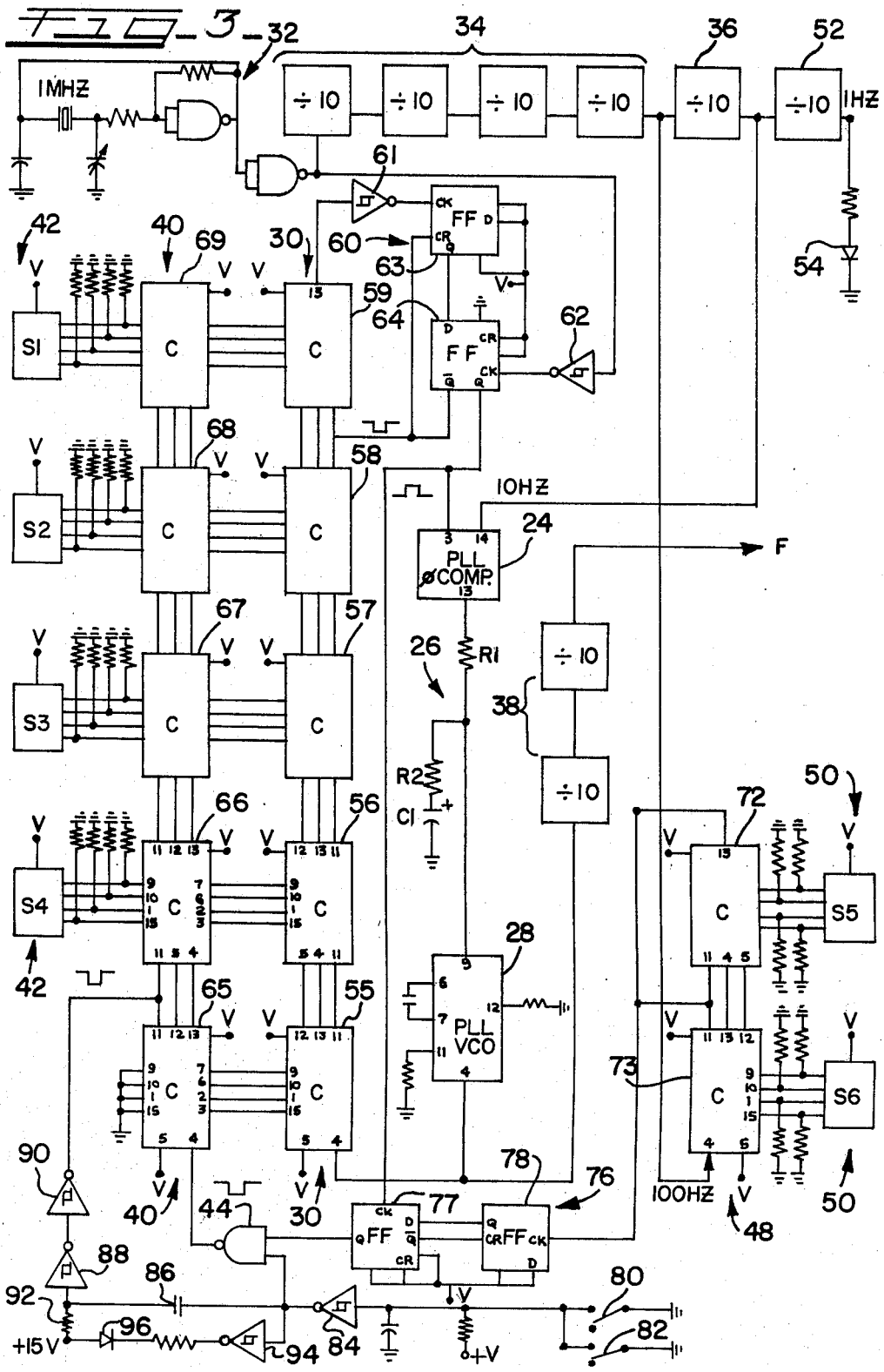
FIG. 3 is a schematic diagram of an embodiment of the reference frequency generator.

Now referring to FIG. 3, the schematic diagram of a specific embodiment of reference frequency generator 22 is shown in more detail than in FIG. 2 but still in simplified form. Oscillator 32 preferably utilizes a crystal to provide a clock frequency R of 1 MHz. Divider 34 which is coupled to the clock includes four divide by ten counters connected in series to divide the 1 MHz clock down to 100 Hz which is the clock input to down counter 48. Divider 36 provides an additional divide by ten to provide a 10 Hz reference frequency to the phase comparator 24 of the phase lock loop. An additional divider 52 provides a 1 Hz output having an LED 54 connected thereto to provide a blinking visual indication that the clock and divider chain are functioning.

The loop filter 26 comprising resistors R1, R2 and capacitor C1 control the damping and settling time of the phase lock loop circuit. The output of VCO 28 (pin 4) is connected to divider 38 having a divisor $M=100$. The VCO output is also connected to programmable divider 30 consisting of counters 55–59.

The output of the programmable divider (counter 59, pin 13) is connected to a synchronizer circuit 60 whose output is connected to phase comparator 24 (pin 3). The synchronizer circuit consists of inverters 61, 62 and type D flip-flops 63, 64. The purpose of circuit 60 is to synchronize the output of the programmable divider with that of the master clock 32.

Down counter 40 consists of counters 65–69 each having its binary coded decimal (BCD) output coupled to the BCD load inputs to counters 55–59, respectively. Thumb wheel switches S1, S2, S3, S4 provide BCD inputs to down counters 69, 68, 67, 66, respectively. Each of the thumb wheel switches can be preset to a number from 0–9. Thumb wheel switch S1 and hence counters 69 and 59 contain the most significant digit of the five digit number contained in programmable divider 30. The load inputs to down counter 65 are connected to ground so that this counter is always preset to zero. Thus, only the four most significant digits of the five digit divisor N are selectable.

Down counter 48 consists of counters 72, 73 which have their BCD load inputs connected respectively to thumb wheel switches S5, S6, i.e. switches 50. Switches S5, S6 are used to load down counter 48 with a preselected number N2 such that the down counter consists of a two digit number with counter 72 containing the most significant digit.

The output of down counter 48 (pin 13 of counter 72) is connected to a synchronizer circuit 76 which couples the counter output signal to gate 44. Synchronizer circuit 76 which consists of flip-flops 77, 78 is used to synchronize the output of down counter 48 with an input (pin 3) of phase comparator 24.

The output of gate 44 is coupled to count down clock input (pin 4) of down counter 65. Each time down counter 48 counts to zero, a pulse is transmitted through gate 44 to counter 65 causing down counter 40 to count down by one count. When down counter 48 reaches zero, it is automatically reloaded to the value N2 determined by switches S5, S6 since its output is connected to its load input (pin 11).

Switches 80, 82 and inverter 84 determine whether gate 44 is inhibited or enabled. These switches can either be conventional manually operable switches or relay contacts. Gate 44 is inhibited when both switches are open, and enabled if either of the switches is closed.

Down counter 40 is loaded each time the output of inverter 84 goes from 1 to 0. When the output of inverter 84 is high (1), capacitor 86 will have a charge of approximately zero volts across it. When the output of 84 goes low (0), the input to inverter 88 will momentarily go low causing the output of inverter 90 to be pulsed low thereby providing a load command to the down counter 40. The input to inverter 88 will return high as soon as capacitor 86 is charged to DC supply voltage through resistor 92. Inverter 94 is used to turn LED 96 on whenever gate 44 is enabled to provide a visual indication of the enable condition.

The circuitry comprising the reference frequency generator may be construed with commercially available components such as: dividers 34, 36, 38, and 52 may be 4518B type integrated circuits; flip-flops 63, 64, 77, 78 may be 74C74B's; phase lock loop IC containing both phase comparator 24 and VCO 28 may be 4046B; and the inverters may be 74C14B's.

Operation of this embodiment of the present invention is described below for a desired initial motor speed of 3,500 rpm. Assume conditions are such that to maintan a constant strand tension the speed of the motor should be decreased at a rate of 12 revolutions each minute. The initial starting speed is preset by setting S1 to 3, S2 to 5, S3 to 0 and S4 to 0. The thumb wheel switches S5, S6 are preset according to the formula wherein the desired rate equals 600/thumb wheel switch number (N2). Thus, to achieve a decreasing rate of speed of 12 revolutions for each minute, switches S5, S6 are set to 50, i.e. N2=50. Momentarily closing one of switches 80, 82 will cause the starting speed to be loaded into down counter 40 and programmable divider 30. The frequency of VCO 28 at pin 4 will initially be 350 KHz which is divided by divider 38 to yield an output frequency F of the generator of 3.5 KHz. The divisor N of the programmable counter equals 35,000; divisor X=10,000 and divisor Y=10. Down counter 48 cycles each 0.5 seconds or 120 times per minute. Thus after one minute N=34,880and F=3488 Hz thereby having reduced the motor by 12 rpm. The motor speed is reduced 0.1 rpm each 0.5 seconds.

When the linear material is ready to be wound about the collet of the motor, switch 80 is closed thereby enabling gate 44 to start decreasing the frequency F which in turn decreases the speed of the motor. At the end of the winding of the package of linear material, the switch 80, which was closed to begin the cycle, is opened which inhibits gate 44 and simultaneously reloads down counter 40 with the initial speed value determined by switches S1–S4. Thus, the reference frequency generator is reset and ready to begin winding another package.

It will be apparent that the initial starting speed of the motor and the rate of decrease of the speed of the motor are controlled independently of each other, that is, the changing of one value does not affect the other. Since the reference frequency generator does not rely upon conventional RC time constants or the like, undesired changes in output frequency due to supply voltage variations are virtually eliminated. The complexity of adjusting a plurality of RC networks to achieve a desired starting speed as was utilized in the prior art should be contrasted with the reference frequency generator of the present invention which only requires the setting of four thumb wheel switches (S1–S4) to the desired rpm of the motor. Thumb wheel switches S5, S6 determine the rate of change of speed. Thus, the present invention permits the desired parameters to be easily entered and changed.

Although an embodiment of the present invention has been described above and illustrated in the accompanying drawings, the scope of the present invention is defined by the claims appended hereto.

That which is claimed is:

1. An apparatus for winding linear material into a wound package comprising:

(a) means for collecting linear material into a wound package;

(b) a motor for rotating said collecting means;

(c) a drive means for controlling the speed of said motor in proportion to the frequency of a signal applied to said drive means; and (d) a digital frequency generator for producing said signal, said generator having a means by use of a first set of manually settable switches to load a first set of down counters which program a programmable divider in a phase locked loop circuit for manually selecting an initial frequency corresponding to a desired initial speed of said motor, and said generator having a means by use of a second set of manually settable switches which load a second set of down counters for manually selecting a rate of frequency change corresponding to a desired rate of decrease in the motor speed by means of sending a pulse at a periodic rate to the first set of down counters to decrement the number stored therein by the first set of manually settable switches, wherein, by selecting an appropriate rate of frequency change, the circumferential speed of the linear material being wound about said collecting means will remain substantially constant thereby maintaining a substantially constant tension on said linear material.

2. The apparatus according to claim 1 wherein said digital frequency generator further comprises:

(a) means for manually selecting a first number by means of the first set of manually settable switches;

(b) means for storing the first number with the first set of down counters;

(c) means for generating a first signal, said first signal being proportional to the frequency of the signal which controls said drive means, having a frequency which is proportional to the first number stored in said first set of down counters;

(d) means for manually selecting a second number by means of the second set of manually settable switches;

(e) means for storing the second number in the second set of down counters;

(f) means for generating periodic pulses proportional to the second number stored in the second set of down counters;

(g) means for decrementing the first number stored in the first set of down counters by the number 1 by use of the programmable divider for each pulse received from the pulse generating means; and (h) means for generating a second signal whose frequency is proportional to the first number decreased by the number of pulses received from the pulse generating means.

3. The apparatus according to claim 1 wherein the first set of manually settable switches are manually selectable binary coded switches.

4. The apparatus according to claim 2 wherein the phase locked loop circuit includes a voltage controlled oscillator.

5. The apparatus according to claim 4 wherein the programmable divider is connected to the phase lock loop circuit so that the frequency output of the voltage controlled oscillator varies in direct proportion to the number stored in the programmable divider.

6. The apparatus according to claim 1 wherein said second set of manually settable switches are manually selectable binary coded decimal switches.

7. An apparatus for winding linear material into a wound package, including a means for collecting said material, a motor for rotating said collecting means and a drive means for controlling the speed of said motor in proportion to the frequency of a signal applied to said drive means, the improvement comprising a digital frequency generator for producing said signal, said generator having:

(a) first means for digitally selecting a first set of manually settable switches;

(b) means for storing the first number selected by means of said first set of manually settable switches into a first set of down counters which program a set of programmable dividers;

(c) means for generating a first signal having a set frequency by use of a crystal controlled oscillator and dividers which feed a phase lock loop circuit including the programmable dividers, a phase lock loop phase comparator, a phase lock loop voltage controlled oscillator to produce a second signal whose frequency is proportional to the first number stored in the first set of down counters, said second signal being proportional to the desired initial speed of the collecting means;

(d) second means for digitally selecting a second number by means of a second set of manually settable switches;

(e) means for storing the second number by means of a second set of down counters;

(f) means for counting down the second number to zero by means of the crystal controlled oscillator and dividers and means for resetting the second set of down counters to the second number upon reaching zero thereby producing a cycle and simultaneously sending a pulse upon completion of said cycle to the first set of down counters to decrement the number stored therein by one count;

(g) means associated with said first set of down counters and programmable dividers for decreasing the frequency of the second signal which was proportional to the first number stored in the first set of down counters for every cycle described in (f) above representative of counting down the second number stored in the second set of down counters to produce a third signal whose frequency is less than the frequency of the second signal so that the new third signal which controls the speed of the motor and, therefore, the speed of the motor is decreased uniformly over time.

8. An apparatus for winding linear material into a wound package comprising:

(a) means for collecting linear material into a wound package;

(b) a motor for rotating said collecting means;

(c) a drive means for controlling the speed of said motor in proportion to the frequency of a signal applied to said drive means; and (d) an electronic circuit consisting of two parts both activated by the same crystal controlled reference oscillator which produces a first frequency, said first frequency is reduced by a first set of dividers to produce a second frequency to be fed to a first part of the electronic circuit, said second frequency further reduced by a second set of dividers to produce a third frequency which is fed to a second part of the electronic circuit which includes a phase lock loop circuit wherein the third frequency is multiplied by the contents of a programmable divider which is programmed by a first set of down counters which are loaded with a first number from a first set of manually settable binary coded decimal switches to produce a fourth frequency, said fourth frequency being divided by a third set of dividers to produce a fifth frequency, said fifth frequency is a frequency in Hertz equvalent to the initial speed of the motor in revolutions per minute, simultaneously accepting the second frequency into the first part of the electronic circuit wherein the second frequency is divided by a second set of down counters which have been loaded with a second number from a second set of manually settable binary coded decimal switches such that the second number stored in the second set of down counters is decremented by one for each cycle defined by the second frequency divided by the second number until the contents of the second set of down counters becomes zero, whereupon the second number set by the second set of manually settable switches is reloaded into the second set of down counters, and, simultaneously, a pulse is sent to the first set of down counters of the first part of the electronic circuit decrementing the first number stored in the programmable divider by one for each pulse received from the second part of the electronic circuit to produce an output frequency which is decremented uniformly over time.

* * * * *